US011549788B2

(12) United States Patent
Martin

(10) Patent No.: US 11,549,788 B2
(45) Date of Patent: Jan. 10, 2023

(54) BLAST HOLE LINER

(71) Applicant: TROUPERDALE PTY LTD, Queensland (AU)

(72) Inventor: Michael Martin, Queensland (AU)

(73) Assignee: TROUPERDALE PTY LTD, Queensland (AU)

( * ) Notice: Subject to any disclaimer, the term of this patent is extended or adjusted under 35 U.S.C. 154(b) by 0 days.

(21) Appl. No.: 17/266,303

(22) PCT Filed: Aug. 8, 2019

(86) PCT No.: PCT/AU2019/050832
§ 371 (c)(1),
(2) Date: Feb. 5, 2021

(87) PCT Pub. No.: WO2020/028952
PCT Pub. Date: Feb. 13, 2020

(65) Prior Publication Data

US 2021/0302135 A1 Sep. 30, 2021

(30) Foreign Application Priority Data

Aug. 8, 2018 (AU) ..... 2018902883

(51) Int. Cl.
*F42B 3/087* (2006.01)
*F42D 1/10* (2006.01)
*F42D 1/22* (2006.01)

(52) U.S. Cl.
CPC ..... *F42B 3/087* (2013.01); *F42D 1/10* (2013.01); *F42D 1/22* (2013.01)

(58) Field of Classification Search
CPC ... F42B 3/087; F42D 1/00; F42D 1/08; F42D 1/10; F42D 1/22
USPC ..... 102/324, 331
See application file for complete search history.

(56) References Cited

U.S. PATENT DOCUMENTS 3,064,572 A 11/1962 Aitchison
3,696,703 A 10/1972 Fox
3,760,727 A * 9/1973 Callister ..... F42B 3/087 102/331
3,881,417 A * 5/1975 Mesia ..... F42B 3/28 102/331
4,019,438 A 4/1977 Swanson
(Continued)

FOREIGN PATENT DOCUMENTS

GB 1189585 A 4/1970
WO 9945337 A1 9/1999
WO 2014030138 A1 2/2014

OTHER PUBLICATIONS

International Search Report and Written Opinion corresponding to PCT/AU2019/050832; dated Oct. 24, 2019 (10 pages).

*Primary Examiner* — James S Bergin
(74) *Attorney, Agent, or Firm* — Myers Bigel, P.A.

(57) ABSTRACT

A blast hole liner is provided having an outer sleeve and an elongate tubing located within the outer sleeve. The outer sleeve is provided with an open first end thereby forming an internal space, adapted to hold an explosive composition. The outer sleeve also has at least one compartment 5 formed in a second end. The elongate tubing is adapted to allow for the entry of compressed air to inflate the elongate tubing and thereby ensure straightening or untwisting of the outer sleeve.

13 Claims, 5 Drawing Sheets

(56) References Cited

U.S. PATENT DOCUMENTS

| | | | | | |
|---|---|---|---|---|---|
| 4,182,242 | A * | 1/1980 | Mesia | F42B 3/087 | 102/331 |
| 4,250,811 | A * | 2/1981 | Mackey | F42B 3/087 | 102/331 |
| 4,464,994 | A | 8/1984 | Porter | | |
| 5,092,245 | A | 3/1992 | Douglas et al. | | |
| 5,192,819 | A * | 3/1993 | Baumgartner | F42D 1/10 | 175/2 |
| 5,936,187 | A | 8/1999 | Miller et al. | | |
| 7,819,063 | B1 * | 10/2010 | Lehman | F42D 1/02 | 102/323 |
| 8,826,821 | B2 * | 9/2014 | Martin | F42B 3/087 | 102/331 |

* cited by examiner

BLAST HOLE LINER

RELATED APPLICATIONS

This application is a 35 U.S.C. § 371 national stage application of PCT Application No. PCT/AU2019/050832, filed on Aug. 8, 2019, which claims priority from Australian Patent Application No. 2018902883, filed on Aug. 8, 2018, the contents of which are incorporated herein by reference in their entireties. The above-referenced PCT International Application was published in the English language as International Publication No. WO 2020/028952 A1 on Feb. 13, 2020.

FIELD OF THE INVENTION

The present invention is concerned with an apparatus and method for lining a blast hole. More particularly, this invention relates to a blast hole liner to locate explosives within a blast hole.

BACKGROUND OF THE INVENTION

In mining applications explosive compositions often need to be placed in drilled blast holes in defined depths and amounts. This helps ensure that the blast rock is broken down in the desired manner leaving rubble and muck pile or fragmentation which is as large as is manageable for more efficient and economical removal.

A blast hole liner may often be used, especially with costly emulsion explosives, to line the blast hole and they often take the form of a simple polymer tubing. The tubing can come in an array of lengths to suit blast holes of differing depths although many are only guaranteed up to 40 m depth in water-filled blast holes for reasons discussed below. The liner prevents the loss of explosives into cracks and fissures in the rock prior to blasting and protects the explosive from the ingress of water. Water can obviously dilute the explosive, necessitating adjustment for this factor, reduce the blast outcome and, in the case of dynamic water, can result in significant and costly loss of explosive.

The liner will therefore encapsulate the explosive composition and protect it from loss and external water ingress. This approach also opens up the possibility of using a lower cost ANFO mix instead of emulsion explosives under certain circumstances.

In use, the liner is typically located on a yolk extending from a truck and dirt or stemming will be added into a lower portion of the liner as weighting to drop the liner to a sufficient depth in the water-filled blast hole. When sufficient stemming is judged by the operator to have been added then that bottom section is sealed, typically by a simple cable tie, to retain the stemming. A further seal above the stemming is also generated on site to keep the stemming separate from the explosives which will be subsequently added. Often this seal is entirely inadequate and so a significant quantity of water can enter the liner upon introduction into a water-filled borehole.

Upon lowering the liner into the blast hole, a common difficulty is the twisting of the liner which can lead to constrictions and knots within portions of the liner. Some prior art liners are concertinaed in an attempt to address this but the reality is that twisting and knotting is still a significant problem. This can effectively shorten the length of the liner available for containing the explosives. In certain situations, it may be that the weight of a detonator dropped into the liner means it finds its way through any constricted section of the liner but the subsequently added explosives do not. This can result in a separation of detonator and explosives and so a misfire in the blast hole. Attempting to realign the twisting of the liner on site can be a time-consuming exercise.

A further challenge is achieving just the right amount of stemming in the liner for an appropriate level of ballast. When ANFO is used, due to its lower density, it tends to float in water and so if insufficient stemming is added initially, then it can be difficult to lower the liner to the required depth. This can be especially challenging when lowering to depths greater than 40 m. Removal of the liner from the blast hole when filled with explosives, to alter the ballast, is generally either not possible or at least highly undesirable.

It would therefore be desirable to have a blast hole liner which addresses one or more of these drawbacks or at least provides the consumer with a useful commercial alternative.

SUMMARY OF THE INVENTION

According to one form, although not necessarily the only or broadest form, the invention resides in a blast hole liner comprising:

an outer sleeve having:

(i) an open first end; and (ii) a second end;

and an elongate tubing located within the outer sleeve.

Preferably, the outer sleeve is elongate between the first end and second end.

In one embodiment, at least one compartment is located adjacent the second end.

Suitably, the at least one compartment extends from the second end of the outer sleeve.

In certain embodiments, the at least one compartment may be an upper compartment and a lower compartment.

The upper and/or lower compartments may take the form of pockets formed by the material continuous with an outer surface of the outer sleeve.

Suitably, the outer sleeve is sealed adjacent the second end.

The seal may be a factory seal extending across the width of the outer sleeve.

In embodiments, the at least one compartment is located adjacent the seal.

In preferred embodiments, the blast hole liner further comprises an inner sleeve. In such embodiments, the elongate tubing is located within the inner sleeve which is itself located within the outer sleeve.

The elongate tubing may extend substantially the length of the interior of the outer sleeve between the open first end and the seal.

The elongate tubing is inflatable.

The elongate tubing may extend beyond the open first end of the outer sleeve, when in use.

The diameter of the elongate tubing may be less than half the diameter of the outer sleeve.

In embodiments, the elongate tubing may be attached to an inner surface of the outer sleeve.

In certain embodiments, the elongate tubing has an open end at its upper extent.

The open end of the elongate tubing may be provided with a valve.

Preferably, the outer sleeve is waterproof.

In embodiments, the outer sleeve is fastened, adjacent the open first end thereof, to a support member.

According to another aspect of the invention there is provided a method of locating an explosive composition in a blast hole comprising the steps of:

providing a blast hole liner comprising an outer sleeve having:

(i) an open first end; and (ii) a second end;

and an elongate tubing located within the outer sleeve;

locating the blast hole liner within the blast hole;

introducing compressed air into the elongate tubing; and locating the explosive composition within the outer sleeve through the open first end, to thereby locate the explosive composition within the blast hole.

Further features of the present invention will become apparent from the following detailed description.

Throughout this specification, unless the context requires otherwise, the words "comprise", "comprises" and "comprising" will be understood to imply the inclusion of a stated integer or group of integers but not the exclusion of any other integer or group of integers.

BRIEF DESCRIPTION OF THE FIGURES

In order that the invention may be readily understood and put into practical effect, preferred embodiments will now be described by way of example with reference to the accompanying figures wherein like reference numerals refer to like parts and wherein.

DETAILED DESCRIPTION OF THE INVENTION

Figure 1:
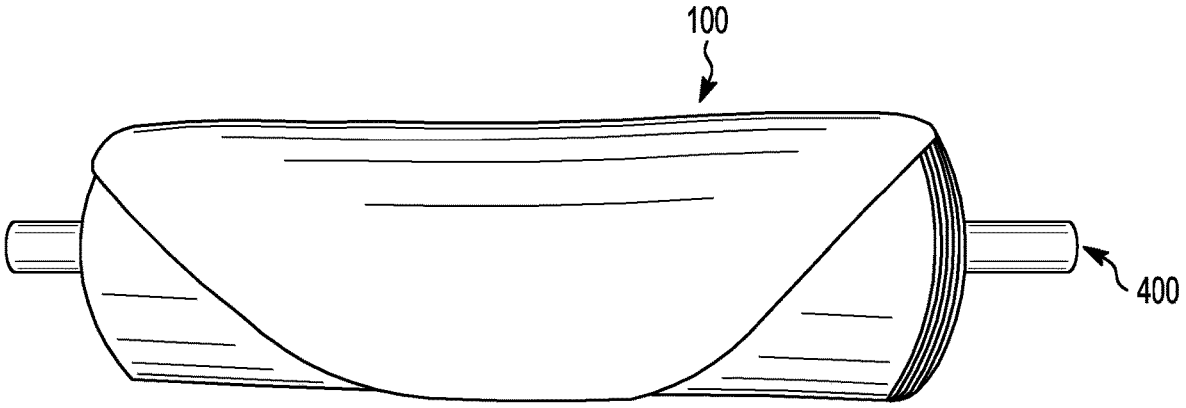
FIG. 1 shows one embodiment of a blast hole liner when rolled around a support member and ready to be deployed.
Figure 2:
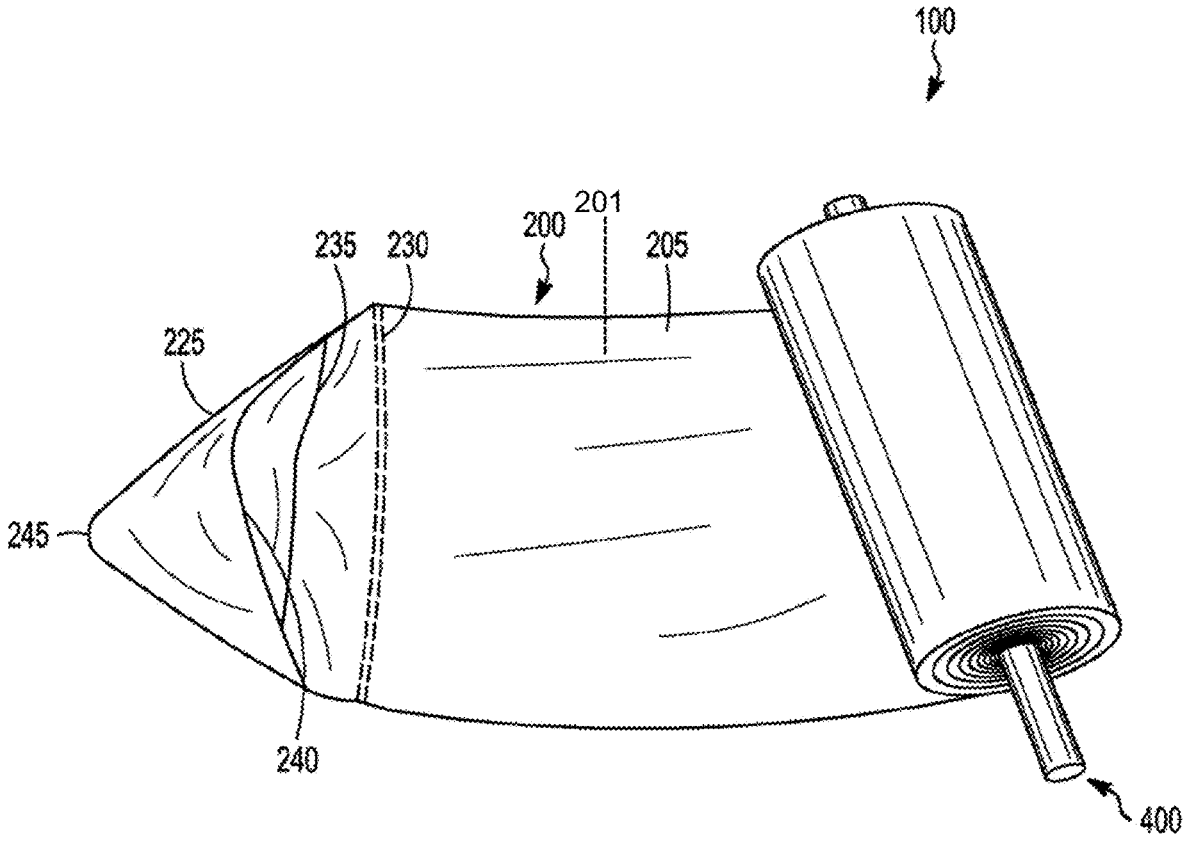
FIG. 2 shows a perspective view of a second end of the outer sleeve of the embodiment of the blast hole liner shown in FIG. 1 including upper and lower compartments.
Figure 3:
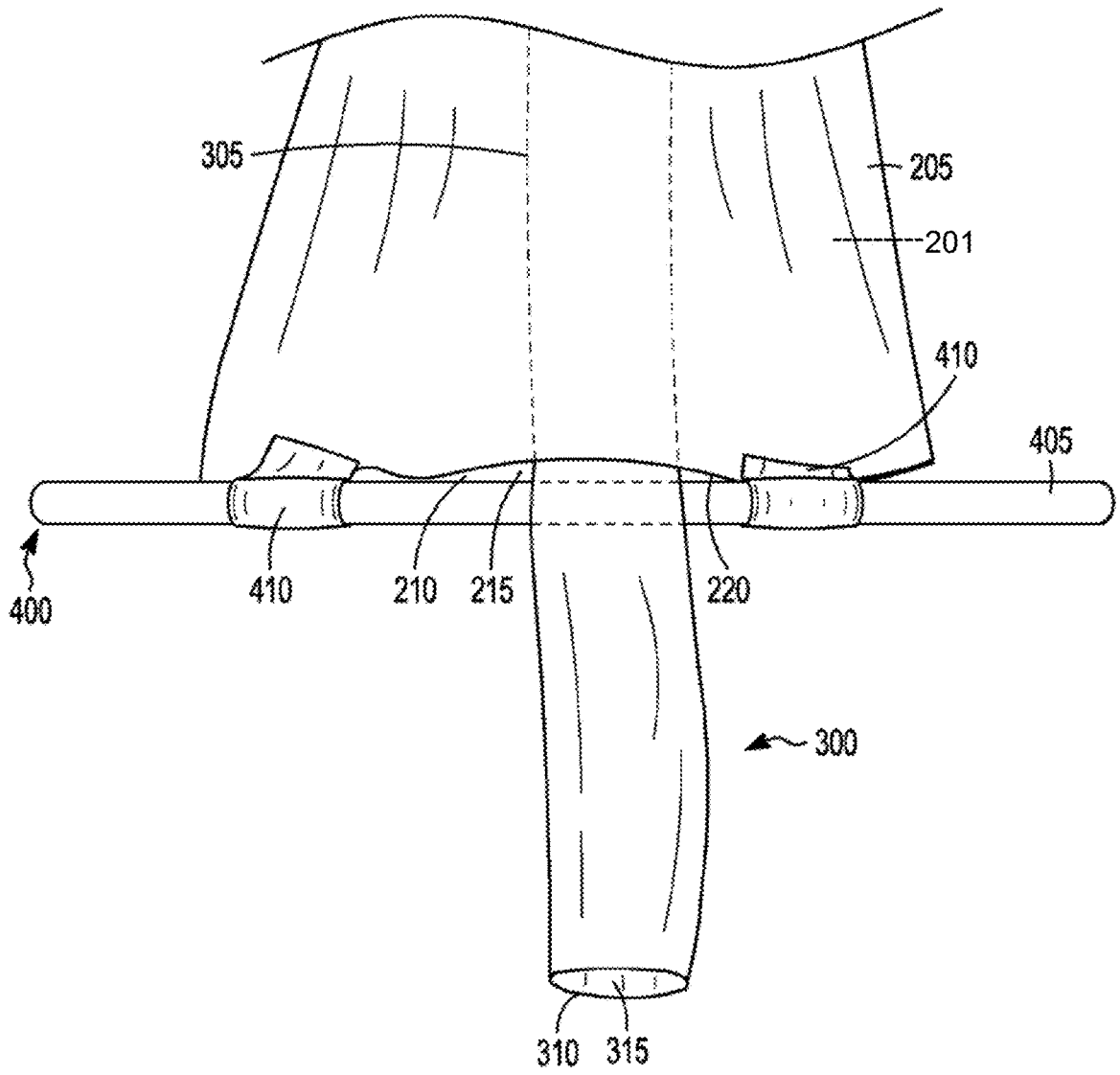
FIG. 3 shows a perspective view of an open first end of the outer sleeve shown in FIG. 2 including the elongate tubing located therein and the attachment to a support member.

Referring to FIGS. 1 to 5, one embodiment of a blast hole liner 100 is shown, the blast hole liner 100 comprises an outer sleeve 200, an elongate tubing 300 and a support member 400. The outer sleeve 200 comprises, as best seen in FIGS. 2 and 3, an elongate body 205 having both external and internal surfaces. The outer sleeve 200 is provided with an open first end 210 thereby forming an internal space 215, adapted to hold an explosive composition, beginning at an upper extent 220 of the outer sleeve 200 thereby forming said open first end 210.

The outer sleeve 200 may be constructed from one or more sheets of material and stitched, adhered, heat sealed or otherwise affixed along a seam. It may be constructed from a tough puncture resistant material such as a woven polypropylene fabric and/or woven polyethylene fabric. Other suitable materials may include polymeric films; knitted, woven or non-woven fabrics of polymeric materials such as polyolefins, polyesters, polyamides and polyurethanes; glass fibre, carbon fibre, KEVLAR™ or like high tensile fibres; natural fibres such as cotton, jute, hemp and the like or mixtures thereof. The outer sleeve 200, when formed from a woven material, may have a 45/45 weave and/or may be at least 600, or at least 700 or at least 800 or about 900 dernier.

In embodiments, the outer sleeve 200 may be UV treated. Further, in certain embodiments, the outer sleeve 200 may be treated with an anti-static additive. The anti-static additive may be added to at least about 1% or at least about 2% by weight of the outer sleeve 200.

Preferably, the outer sleeve 200 is made from a high tensile woven polypropylene. Suitably, the outer sleeve 200 is substantially waterproof or water resistant. In embodiments, the material forming the outer sleeve 200 is further impregnated with a polymer, such as polypropylene.

The internal volume of the outer sleeve 200 may be at least 50 liters, preferably at least 55 liters.

Figure 5:
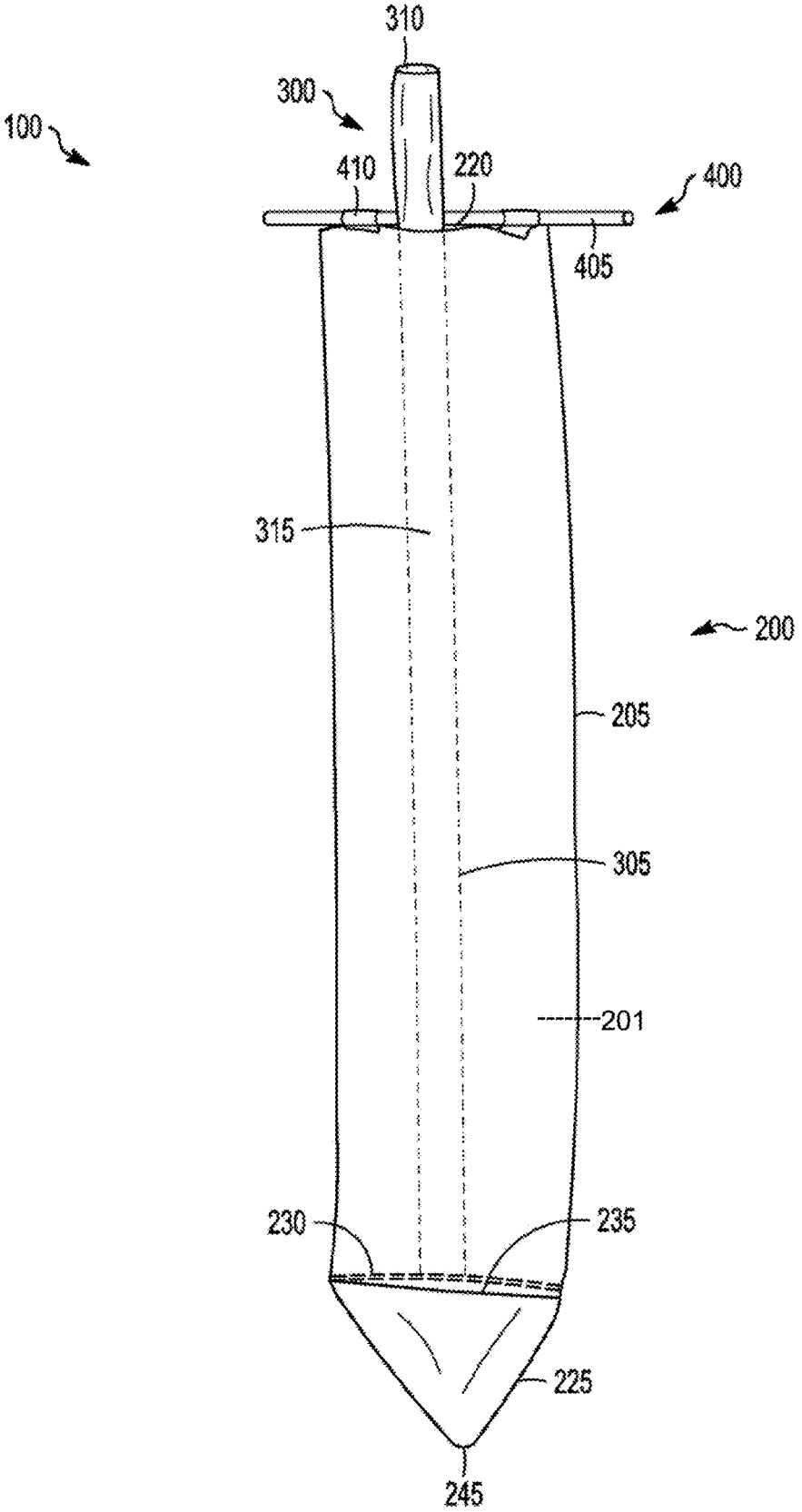
FIG. 5 is a plan view of the blast hole liner of the previous figures when completely extended and showing in dashed line the location of the elongate tubing within the interior of the outer sleeve.

In certain embodiments, the outer sleeve 200 may be provided with an inner sleeve 201 (see, e.g., FIGS. 2, 3, and 5). The inner sleeve 201 may be a close or snug fit within the outer sleeve 200. That is, the dimensions of the inner sleeve 201 may be marginally less than those of the region of the outer sleeve 200 within which it fits. Put another way, the inner sleeve 201 is substantially in contact, across the majority of its outer surface, with the inner surface of the outer sleeve 200. In embodiments, the inner sleeve 201 is substantially in contact, across substantially all of its outer surface, with the inner surface of the outer sleeve 200.

The inner sleeve may be comprised of one or more water resistant or waterproof layers which may add to the water resistance. In one preferred embodiment, the outer sleeve 200 is lined with a waterproof inner sleeve. The inner sleeve is substantially strong enough in its own right to contain the explosives and so acts as not only a further waterproof layer protecting the explosives but also as an extra layer of protection should the outer sleeve 200 become damaged during use.

The inner sleeve may be formed a polymer selected from the group consisting of polyethylene, ethylene vinyl alcohol and nylon. Preferably, the inner sleeve is a co-extrusion of all three of these polymers.

In embodiments, the inner sleeve is attached or fixed to the inner surface of the outer sleeve adjacent the seal 230. The inner sleeve may also be attached or fixed to the inner surface of the outer sleeve adjacent the open first end 210. The fixing of the inner sleeve at one or both of these areas prevents the inner sleeve from sliding down into the internal space 215 or from being pulled out of said internal space 215. However, importantly, the inner sleeve may not be fixed or attached between these areas. This allows for flexibility in movement of the inner sleeve within the outer sleeve 200. When being lowered into a borehole it is not uncommon for the outer sleeve 200 to catch or snag on a sharp rock. This may damage the outer sleeve's 200 integrity and could also compromise the integrity of the inner sleeve if it was entirely affixed to the inner surface of the outer sleeve 200. With the inner sleeve only attached near the seal 230 and open first end 210 it can move independently of the outer sleeve 200 and is much less likely to snag on the same sharp rock and become damaged.

The elongate body 205 of outer sleeve 200 ends in a nose 225 which, in the embodiment show is substantially conical. The nose 225 has formed within it at least one compartment 235. The at least one compartment is formed as a pocket within the boundary of nose 225 and is capable of holding a sufficient amount of stemming, such as gravel or dirt, to allow the blast hole liner to be located at a desired depth within a water-filled blast hole. In embodiments, the at least one compartment 235 has an internal volume or capacity of at least 10 liters, preferably at least about 13, 14 or 15 liters.

Figure 4:
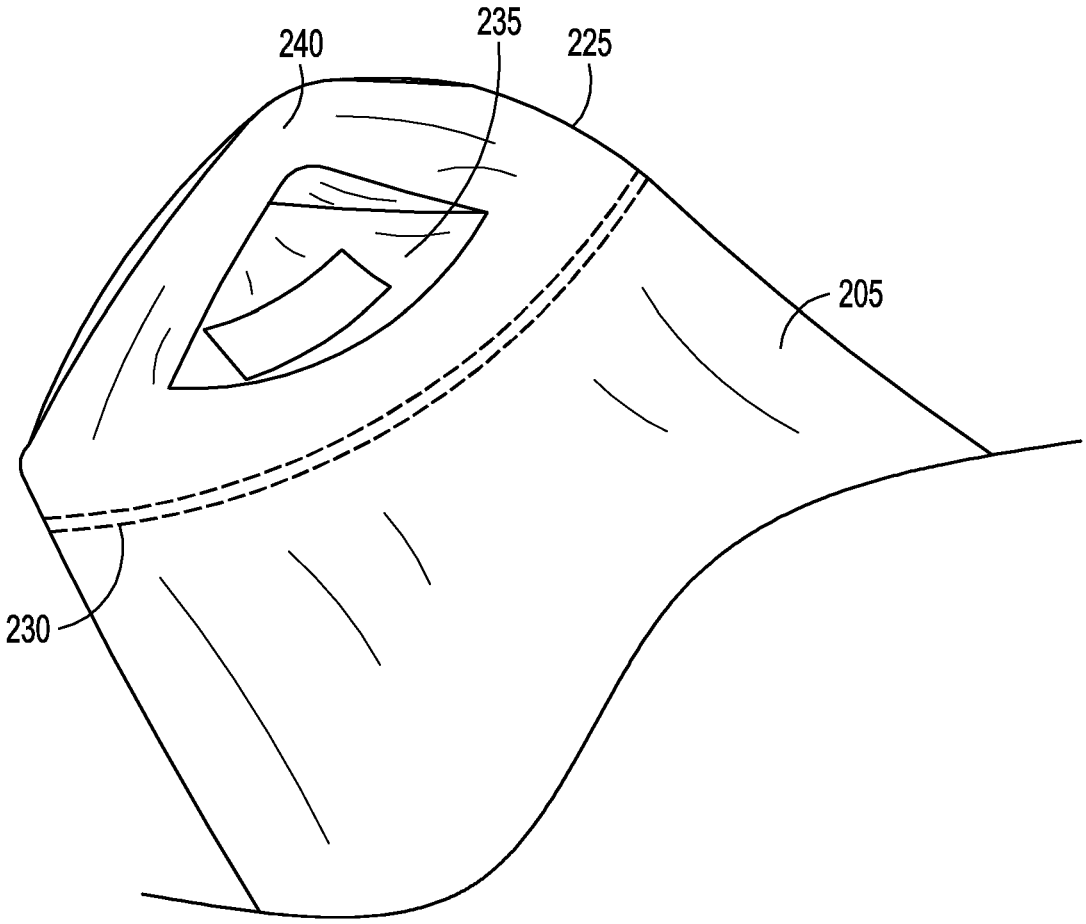
FIG. 4 is a perspective view of the embodiment of the previous figures when looking down into the upper and lower compartments.

In the embodiment shown in FIGS. 2 and 4 the at least one compartment 235 is an upper compartment 235 and a lower compartment 240. The lower compartment 240 opens closer to a nose end 245 of the nose 225 than the upper compartment 235. The upper compartment 235 is larger than the lower compartment 240 and so can hold a greater volume of stemming. The lower compartment 240 can act to capture any stemming spillage or overflow from the upper compartment 235 either during filling or during subsequent movement of the blast hole liner 100.

The outer sleeve 200 therefore has a first open end 210 and extends down to a second end which may be considered to be seal 230 which, internally, forms the end of the internal space 215 or the nose end 245 since the nose 225 is continuous with the elongate body 205 of the outer sleeve 200. The seal 230 is a factory seal and so is integrally formed within the elongate body 205. The seal 230 is therefore a substantially complete seal and/or a substantially watertight seal. The seal 230 may further comprise a factory stitching substantially across its length. This is a significant advantage over prior art liners which, as described above, typically have only cable tie fastening to separate the stemming from the explosive and maintain watertightness. A factory seal is much more effective in maintaining separation between the internal space 215 and the exterior environment and does not rely on the effectiveness of operator closure on site. As mentioned, the inner sleeve may be affixed adjacent the seal 230 in the internal space 215.

The outer sleeve 200 may, optionally, be attached to a support member 400 which, in the embodiment shown, takes the form of a pipe or pole 400. The pole 400 has a cylindrical body 405, although the shape of the body 405 is not of particular importance. The external surface of the outer sleeve 200 is attached to the pole 400 by the use of one or more fasteners 410. The fasteners 410 may be adhesive strips, Velcro™ or mechanical fasteners such as clips, hooks, pegs, buttons and the like. The pole 400 may be useful both in rolling up the blast hole liner 100, when not in use and, as seen in FIG. 1, in supporting it when it is to be lowered into the blast hole.

FIGS. 3 and 5 best demonstrate the elongate tubing 300 and the manner in which it may extend substantially the length of the interior or internal space 215 of the outer sleeve 200 between the open first end 210 and the seal 230. FIG. 3 indicates that the elongate tubing 300 has an elongate body 305, an upper extent 310 which is the end of elongate tubing 300 located furthest from the seal 230 of the outer sleeve 200. The elongate tubing 300 is formed to have an internal volume 315.

The elongate tubing 300, which may also be referred to as an air sleeve, may be formed by a heat welding process from a polyethylene, polypropylene, nylon film or a co-extrusion such as nylon/surlyn or polyethylene/nylon/polyethylene. Preferably, the elongate tubing is formed from polyethylene. The elongate tubing will be substantially airtight.

The elongate tubing 300 is adapted to receive introduced air during use. Typically, during use, compressed air will be forced into the upper extent 310 of the elongate tubing 300 such that the previously flat elongate tubing 300 expands with the compressed air. This provides significant advantages in operation compared with prior art liners. The drawbacks of such liners has been discussed in terms of twisting or knotting caused during lowering of the liner into the blast hole either by natural twisting of the liner material or forced twisting due to snagging or dynamic water in the blast hole. If the present blast hole liner 100 should twist when lowered into the blast hole then compressed air can quickly and easily be introduced into the internal volume 315 of the elongate tubing 300 and the expansion of said tubing 300 will force the outer sleeve 200, and inner sleeve when present, to untwist and become straight again with a continuously open internal spacing 215 such that explosive composition can be introduced without blockages interrupting the flow.

The elongate tubing 300 may therefore extend beyond the open first end 210 of the outer sleeve to allow for easy access to introduce the compressed air. It may be sufficient to introduce the compressed air into the open upper extent 310 shown in FIG. 3. This allows the elongate tubing 300 to expand or inflate, as discussed. However, it may be desirable to have the inflated elongate tubing 300 remain in an inflated state without requiring continued connection to the compressed air source. Therefore, in some embodiments, the upper extent 310, i.e. the open end of the elongate tubing 300, may be provided with a valve. The valve may be selected from any air valves which are known in the art for allowing the introduction of compressed air but preventing the subsequent escape of said air without operator intervention. A double valve air valve, such as is found on inflatable watercraft, may be appropriate.

The size of the elongate tubing 300 relative to the outer sleeve 200 must be such that inflation of the elongate tubing is sufficient to force the walls of the outer sleeve 200 to untwist. In embodiments, the diameter of the elongate tubing 300 may be less than half the diameter of the outer sleeve 200. In further embodiments, the diameter of the elongate tubing 300 may be less than one third or one quarter or one fifth of the diameter of the outer sleeve 200.

In embodiments, the elongate tubing 300 may be attached to an inner surface of the outer sleeve 200 or of the inner sleeve, if present. This may be for convenience and to ensure that the elongate tubing 300 remains substantially centrally located within the internal spacing 215 to allow for maximum impact when it is inflated. In one embodiment, the elongate tubing may be attached to an inner surface of the outer sleeve or inner sleeve adjacent the upper extent 220 thereof of either.

Alternatively, it may be desirable for the elongate tubing 300 simply to be freely located within the bounds of the internal spacing 215 of outer sleeve 200 or the inner sleeve, if present. The elongate tubing 300 can therefore be thought of as floating within the bounds of the inner surface of the outer sleeve 200 and/or inner sleeve. This can assist in reducing the likelihood of damage to the elongate tubing 300 if the outer sleeve 200 snags upon a rock or other jagged surface upon being lowered into the hole. This snagging, if the elongate tubing 300 is fixed to the inner surface of the outer sleeve 200, may otherwise result in a tearing of the elongate tubing 300. Therefore, in one embodiment, the elongate tubing 300 is located within the internal spacing 215 of outer sleeve 200, or the inner sleeve, but is not fixed or attached to the inner surface forming said internal spacing 215.

Importantly, it is preferred that the elongate tubing 300 is not attached to an inner surface of the outer sleeve 200 at a lower end thereof. That is, the region of the elongate tubing approaching the seal 230 or even below half way between the upper extent of the outer sleeve 200 and the seal 230 should not be attached to the outer sleeve 200 or fastened in any way. This is because it has been found that the rapid entry of compressed air into the elongate tubing 300 causes the free far end (opposite the end through which the air is introduced) to move rapidly or thrash from side to side within the internal spacing 215 of the outer sleeve 200 which greatly assists in the process of untwisting the outer sleeve 200 and forcing it to adopt the desired straightened configuration.

With reference to the progression of FIGS. 1 to 5, the use of the blast hole liner 100 will now be described. The blast hole liner 100 may come conveniently rolled around and attached to the support member or pole 400 and optionally fastened in place with a strip of adhesive. The adhesive can be removed on site and the outer sleeve 200 unrolled, nose 225 end first, a sufficient amount to allow the appropriate amount of stemming to be added to the upper compartment 235 and, if necessary, the lower compartment 240. The amount of stemming to be added is judged by the operator based on the depth the blast hole liner 100 is to be located at within a water-filled blast hole.

The blast hole liner 100 can then be lowered, while supported by the support member 400, into the blast hole to the desired depth until a position such as is shown in FIGS. 3 and 5 is reached. The shaping of the nose 225 end of the outer sleeve 300, while not essential for operation, provides for smooth lowering with a reduced chance of snagging. It has also been found that the location of the at least one compartment 235 as a pocket causes the outer sleeve 200 to maintain an optimal front leaning orientation during descent. At this point the outer sleeve 200 may well be twisted due to the lowering process or the force of dynamic water in the blast hole. To ensure appropriate loading of explosive composition into the internal spacing 215, or the internal spacing of the inner sleeve located therein, a compressed air source is then connected to the upper extent or open end of the elongate tubing 300. If the elongate tubing 300 is provided with a valve then the compressed air outlet is suitably connected to the valve.

Compressed air is then introduced into the internal volume 315 of the elongate tubing 300 to cause it to expand and inflate into a generally cylindrical shape. This expansion, due to the size of the elongate tubing 300, is sufficient to place force on the inner surface of the outer sleeve 200, and inner sleeve when present, such that it is forced to adopt a straightened or untwisted configuration. In effect, the inflation of the elongate tubing 300 results in the formation of a vertical air-filled core within the outer sleeve 200. This air-filled core runs substantially the length of the outer bag 200, or at least the majority thereof, down to the seal 230. An explosives booster or detonator may be introduced at this point if they have not been located therein already.

Since the configuration of the internal spacing 215 is now optimal for the uninterrupted flow of explosive composition, as this is normally a flowable mixture, it can now be pumped or otherwise introduced into the confines of the outer sleeve 200 and/or inner sleeve and, specifically, into the internal spacing 215, or the internal spacing of the inner sleeve, until a sufficient quantity has been introduced. The presence of the compressed air within the elongate tubing 300 prevents further twisting during this filling process and ensures both adequate filling and good contact between the explosive and the detonator.

At this point, the operator has a choice in that they can allow the compressed air to leave the internal volume 315 of the elongate tubing 300, either simply by turning off the source, if a valve is not present on the elongate tubing 300, or by allowing the valve to open if one is located on the elongate tubing 300.

It is a distinct advantage of the present blast hole liner 100 that the compressed air can remain within the elongate tubing 300 allowing it to remain inflated during location and even subsequent use of the blast hole liner 100. Allowing the elongate tubing 300 to remain inflated clearly alters the buoyancy of the blast hole liner 100 thereby providing the operator with a further level of fine control over the location of the liner 100. The added buoyancy can be used to achieve a desired depth or, if it is subsequently found that the liner 100 will not sink to the depth desired due to insufficient stemming, then all or a portion of the air from the elongate tubing 300 can be allowed to escape to allow the liner 100 to sink further.

Further, and importantly, the inflation of the elongate tubing 300 takes up a greater proportion of the internal spacing 215 within the outer sleeve 200. This means that less explosive composition is required to fill the internal spacing 215, or the internal cavity of the inner sleeve, to a desired depth and so the powder factor for the blast is reduced. Explosives, and especially emulsion explosives, are expensive and so any means of reducing the powder factor is highly valuable to the operator in savings 'per blast'. The level of control is important and so, if a higher powder factor is required for any blast, then the air from the inflated elongate tubing 300 can be completely or partially released during filling of the outer sleeve 200 with explosives composition to adjust for the preferred powder factor. This level of control is not provided for by any prior art liner which simply has an internal volume within the liner which cannot be adjusted in any way and which does not have an inflatable tubing located therein. It has been found that the powder factor may be reduced by up to 20% and ideally about 17% and the desired blast profile still achieved.

Therefore, according to another aspect of the invention, there is provided a method of locating an explosive composition in a blast hole comprising the steps of:

providing a blast hole liner comprising an outer sleeve having:

(iii) an open first end; and (iv) a second end;

and an elongate tubing located within the outer sleeve;

locating the blast hole liner within the blast hole;

introducing compressed air into the elongate tubing; and locating the explosive composition within the outer sleeve through the open first end thereof;

to thereby locate the explosive composition within the blast hole.

The blast hole liner may be as described in any previous embodiment.

The method may include the step of retaining the compressed air within the elongate tubing 300. This can allow control over the physical space taken up by the elongate tubing 300 with the internal spacing 215 of the outer sleeve 200.

In one embodiment, the method may include the step of releasing the compressed air from within the elongate tubing 300.

Throughout the specification the aim has been to describe the preferred embodiments of the invention without limiting the invention to any one embodiment or specific collection of features. It will therefore be appreciated by those of skill in the art that, in light of the instant disclosure, various modifications and changes can be made in the particular embodiments exemplified without departing from the scope of the present invention.

The invention claimed is:

1. A blast hole liner comprising:

(a) a flexible elongate outer sleeve having:

(i) an open first end;

(ii) a second end comprising a seal; and (iii) a nose forming the furthest end of the blast hole liner from the open first end, the nose adjacent the second end such that the second end is located between the open first end and the nose, the nose having at least one compartment formed on the surface thereof;

(b) an inner sleeve located within the outer sleeve; and (c) a flexible elongate tubing located within the inner sleeve and extending substantially between the open first end and second end of the outer sleeve.

2. The blast hole liner of claim 1, wherein the diameter of the elongate tubing is less than half that of the outer sleeve.

3. The blast hole liner of claim 1, wherein the elongate tubing has an open end at its extent closest to the open first end of the outer sleeve.

4. The blast hole liner of claim 1, wherein the elongate tubing has one closed end being that end closest to the second end of the outer sleeve.

5. The blast hole liner of claim 1, wherein the outer sleeve is fastened, adjacent the open first end, to a support member.

6. The blast hole liner of claim 1 wherein the inner sleeve is substantially in contact, across the majority of its outer surface, with an inner surface of the outer sleeve.

7. The blast hole liner of claim 6 wherein the inner sleeve is attached to the inner surface of the outer sleeve adjacent the second end.

8. The blast hole liner of claim 7 wherein the inner sleeve is further attached to the inner surface of the outer sleeve adjacent the open first end.

9. The blast hole liner of claim 1, wherein the at least one compartment is an upper compartment and a lower compartment.

10. The blast hole liner of claim 1, wherein the material forming the flexible elongate tubing is substantially airtight.

11. The blast hole liner of claim 1, wherein the flexible elongate tubing is not fixed to an inner surface of the flexible water-resistant inner sleeve adjacent the second end of the outer sleeve.

12. A blast hole liner comprising:

(a) a flexible elongate outer sleeve having:

(i) an open first end;

(ii) a second end comprising a seal;

(iii) a nose forming the furthest end of the blast hole liner from the open first end, the nose adjacent the second end such that the second end is located between the open first end and the nose, the nose having at least one compartment formed on the surface thereof;

the outer sleeve being elongate between the first end and second end;

(b) a flexible water-resistant inner sleeve located within the outer sleeve and extending substantially between the open first end and the second end of the outer sleeve and which is substantially in contact, across the majority of its outer surface, with an inner surface of the outer sleeve;

(c) a flexible elongate tubing located within the inner sleeve and extending substantially between the open first end and second end of the outer sleeve and wherein the diameter of the flexible elongate tubing is less than half that of the outer sleeve.

13. A blast hole liner comprising:

(a) a flexible elongate outer sleeve having:

(i) an open first end;

(ii) a second end comprising a seal;

(iii) a nose forming the furthest end of the blast hole liner from the open first end, the nose adjacent the second end such that the second end is located between the open first end and the nose, the nose having at least one compartment formed on the surface thereof;

the outer sleeve being elongate between the first end and second end;

(b) a flexible water-resistant inner sleeve located within the outer sleeve and extending substantially between the open first end and the second end of the outer sleeve and which is substantially in contact, across the majority of its outer surface, with an inner surface of the outer sleeve;

(c) a flexible elongate tubing formed from a substantially airtight material and located within the inner sleeve and extending substantially between the open first end and second end of the outer sleeve and wherein the diameter of the flexible elongate tubing is less than half that of the outer sleeve, wherein the flexible elongate tubing is not fixed to an inner surface of the flexible water-resistant inner sleeve adjacent the second end of the outer sleeve.

* * * * *